US011807509B2

(12) United States Patent
O'Brien et al.

(10) Patent No.: US 11,807,509 B2
(45) Date of Patent: Nov. 7, 2023

(54) MATERIAL HANDLING APPARATUS FOR A UTILITY VEHICLE

(71) Applicant: Deere & Company, Moline, IL (US)

(72) Inventors: David M. O'Brien, Asbury, IA (US); Arun Narayanan, East Moline, IL (US); Jason M. Simmons, Platteville, WI (US); Christopher P Kelley, Dubuque, IA (US); Devendra Thakur, Pune (IN); Rajan Kadam, Pune (IN); William M. Banish, Dubuque, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 17/451,491

(22) Filed: Oct. 20, 2021

(65) Prior Publication Data

US 2023/0119845 A1 Apr. 20, 2023

(51) Int. Cl.
*B66F 9/18* (2006.01)
*B66F 9/075* (2006.01)

(52) U.S. Cl.
CPC ..... *B66F 9/18* (2013.01); *B66F 9/07504* (2013.01)

(58) Field of Classification Search
CPC ..... E02F 3/413; E02F 3/4133; B66F 9/18
See application file for complete search history.

(56) References Cited

U.S. PATENT DOCUMENTS 3,119,637 A * 1/1964 Eaves ..... B66F 9/18 414/622
3,120,898 A 2/1964 Eaves
3,817,567 A * 6/1974 Lull ..... B66F 9/18 294/197
4,459,080 A * 7/1984 Walter ..... B66F 9/18 414/661
4,565,485 A * 1/1986 Wilman ..... A01D 87/0069 414/726
5,509,774 A * 4/1996 Yoo ..... B66F 9/18 414/622

(Continued)

FOREIGN PATENT DOCUMENTS

CN 106167239 A 11/2016
CN 209113428 U 7/2019

(Continued)

OTHER PUBLICATIONS

1972 Patrick AR10-C 4×4 Rough Terrain Forklift with Clamps, pp. 1-4 [online]. Retrieved from the Internet <URL: https://www.repo.com/listing/14849>.

(Continued)

*Primary Examiner* — Mark C Hageman

(57) ABSTRACT

In accordance with an example embodiment a clamping device comprising a first clamping device frame element coupled with a portion of a work tool coupled with the utility vehicle, a second clamping device frame element pivotally coupled with the first clamping device frame element, where the second clamping device frame element includes a first section and a second section, where the first section and the second section are positioned at an angle of approximately 90 degrees relative to each other, and a first movement actuator that movably couples the first clamping device frame element and the second clamping device frame element.

15 Claims, 13 Drawing Sheets

(56) References Cited

U.S. PATENT DOCUMENTS

| | | | | |
|---|---|---|---|---|
| 2014/0121825 | A1* | 5/2014 | McKernan | B66F 9/183 700/213 |
| 2015/0042116 | A1 | 2/2015 | Jacobson | |
| 2022/0002127 | A1* | 1/2022 | O'Shaughnessy | B66F 9/187 |
| 2022/0063973 | A1* | 3/2022 | Hamlik | B66F 9/0755 |

FOREIGN PATENT DOCUMENTS

| | | | |
|---|---|---|---|
| CN | 211310719 | U | 8/2020 |
| CN | 114275715 | A | 4/2022 |
| CN | 216863568 | U | 7/2022 |

OTHER PUBLICATIONS

Attachments—moving challenges, Mar. 7, 2019, pp. 1-4 [online]. Retrieved from the Internet <URL: https://www.forkliftaction.com/news/newsdisplay.aspx?nwid=21568>.

* cited by examiner

MATERIAL HANDLING APPARATUS FOR A UTILITY VEHICLE

TECHNICAL FIELD

The present disclosure generally relates to a utility vehicle. An embodiment of the present disclosure relates to a material handling apparatus for utility vehicles.

BACKGROUND

Utility vehicles, such as wheel loaders and skid and track loaders often move material that does not fit well on existing attachments. Operators often use a fork attachment to move various materials/items. Exemplary materials that pose a challenge can include logs, pipes, containers, etc. A material handling attachment that could allow for improved handling of items on a fork attachment is needed.

SUMMARY

Various aspects of examples of the present disclosure are set out in the claims.

According to a first aspect of the present disclosure, a clamping device can comprise a first clamping device frame element coupled with a portion of a work tool coupled with the utility vehicle, a second clamping device frame element pivotally coupled with the first clamping device frame element, where the second clamping device frame element includes a first section and a second section, where the first section and the second section are positioned at an angle of approximately 90 degrees relative to each other, and a first movement actuator that movably couples the first clamping device frame element and the second clamping device frame element.

According to a second aspect of the present disclosure, A material handling attachment for a work tool, the material handling attachment comprising: a primary load retention apparatus comprising: a first load retention apparatus element coupled with a portion of the work tool, a second load retention apparatus element pivotally coupled with the first load retention apparatus element, where the second load retention apparatus element includes a first section and a second section, where the first second and the second section are positioned at an angle of approximately 90 degrees relative to each another, and a first movement actuator that movably couples the first load retention apparatus element and the second load retention apparatus element, a secondary load retention apparatus comprising: a third load retention apparatus element, and a second movement mechanism, wherein the second movement mechanism movably couples the third load retention apparatus element and the second load retention apparatus element of the first retention mechanism.

The above and other features will become apparent from the following description and accompanying drawings.

BRIEF DESCRIPTION OF THE DRAWINGS

The detailed description of the drawings refers to the accompanying figures in which.

Like reference numerals are used to indicate like elements throughout the several figures.

DETAILED DESCRIPTION

Figure 1:
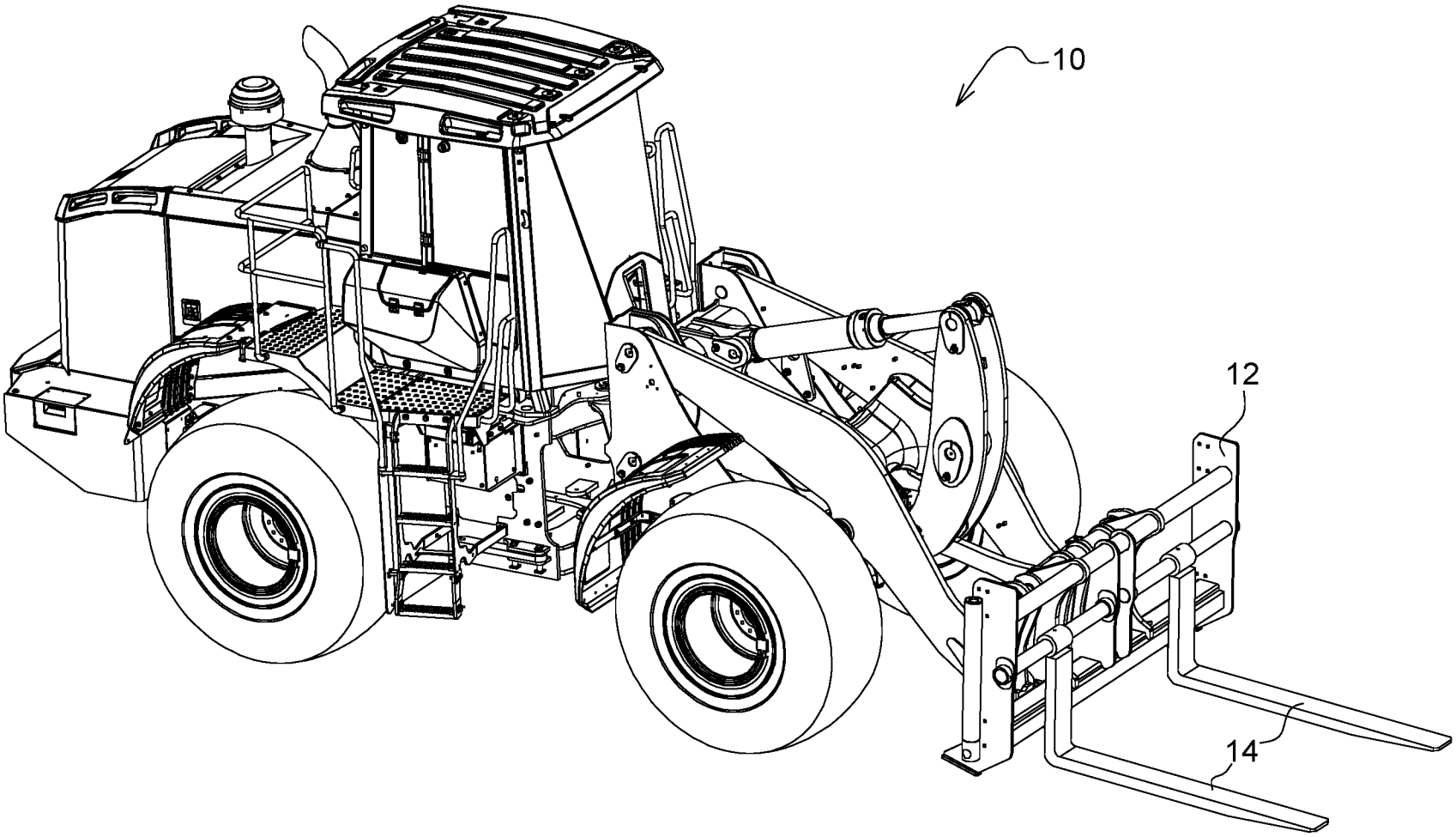
FIG. 1 is a side view of a utility vehicle with a blade, consistent with embodiments of the present disclosure.

At least one example embodiment of the subject matter of this disclosure is understood by referring to FIGS. 1 through 9 of the drawings.

While the present disclosure has been illustrated and described in detail in the drawings and foregoing description, such illustration and description is not restrictive in character, it being understood that illustrative embodiment(s) have been shown and described and that all changes and modifications that come within the spirit of the present disclosure are desired to be protected. Alternative embodiments of the present disclosure may not include all of the features described yet still benefit from at least some of the advantages of such features. Those of ordinary skill in the art may devise their own implementations that incorporate one or more of the features of the present disclosure and fall within the spirit and scope of the appended claims.

Currently, in certain scenarios utility vehicle operators often encounter situations where material that need to be moved, loaded, or unloaded pose a challenge for the attachment on the utility vehicle. If the utility vehicle has a fork attachment, or a bucket, or other attachments, moving items like logs, pipe, containers, or bulking items is difficult, if not impossible.

In some situations, an operator may want to spread material while moving in reverse, depositing some of the material that accumulated on the blade during the forward grading pass. Again, this becomes a manual operation where the operator is required to, after completing a forward grading pass, to lift the blade some amount when reverse is engaged to spread the material while reversing.

Advantages for the embodiments described herein include: increased productivity as operator doesn't have to change attachments to move different kinds of materials.

The embodiments described herein provide automation to this process and improve it by using sensors capable of determining a distance, including for example, ultrasonic, radar, lidar, and other similar sensor, to take intelligent decisions on next grading position and material spread and could assist in precision grading every time without operator intervention or with limited operator intervention. This process can also reduce operator fatigue and increase operator productivity.

FIG. 1 is an isometric view of a utility vehicle with a fork attachment, consistent with embodiments of the present disclosure. FIG. 1 illustrates a utility vehicle in the form of a wheel loader 10. Although a utility vehicle is illustrated and described as the wheel loader 10, the utility vehicle may include, for example, skid and track loaders, forklifts, or any other utility vehicle that uses a work tool compatible with the material handling attachment described herein.

The wheel loader 10 includes a fork attachment 12. The fork attachment 12 includes two tines 14. The fork attachment 12 can be moved by an operator, with movement including raising and lowering of the fork attachment and tilting the fork attachment 12. The tilting movement causes tips 16 of the fork tines 14 to either raise up (i.e., tilt up, tilt back, etc.) or lower (i.e., tilt down, tile forward, etc.).

Figure 2:
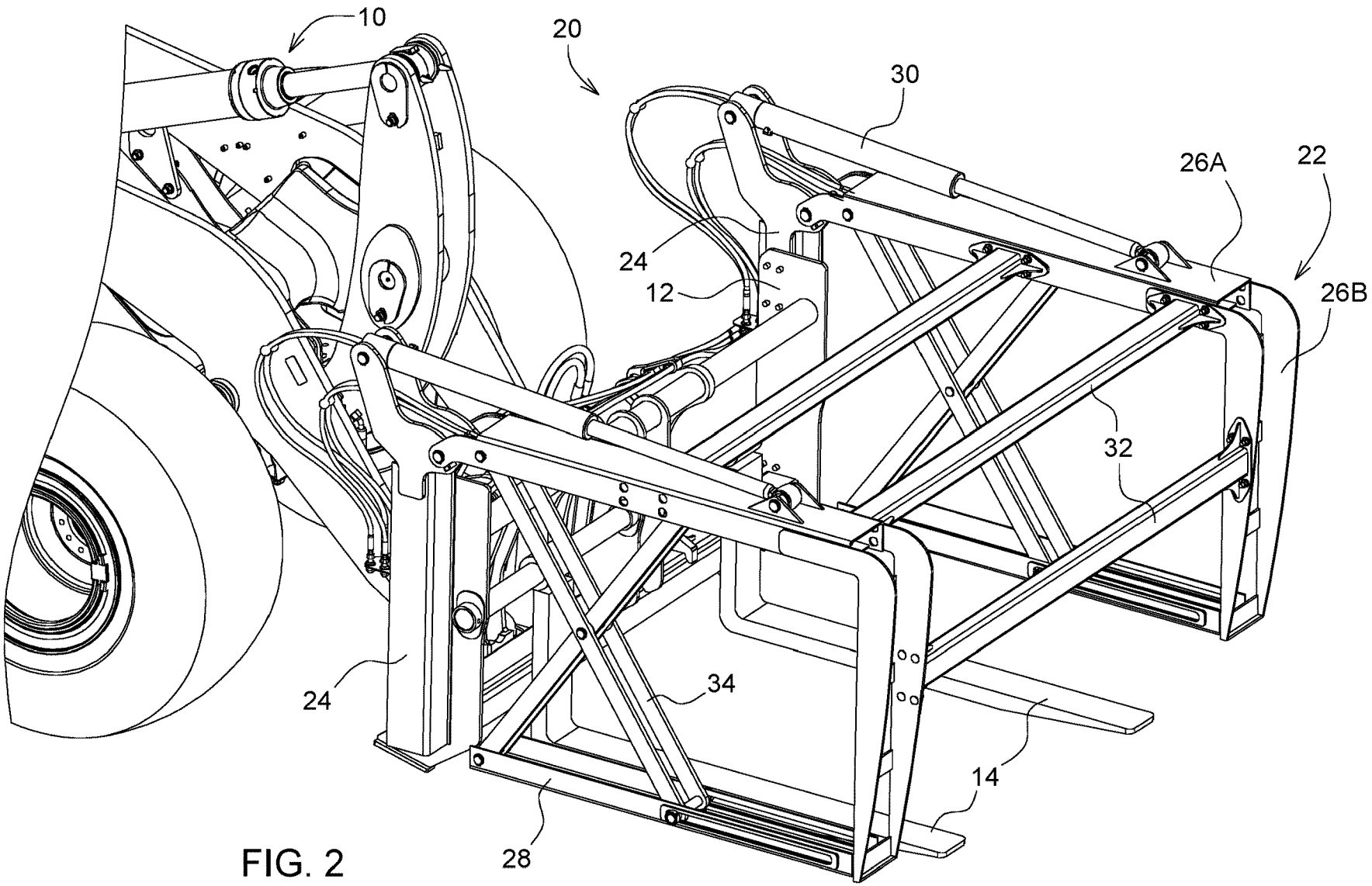
FIG. 2 is an isometric view of the wheel loader of FIG. 1 with a fork attachment with a material handling attachment, consistent with embodiments of the present disclosure.

FIG. 2 is an isometric view of the wheel loader of FIG. 1 with a fork attachment with a material handling attachment, consistent with embodiments of the present disclosure. The wheel loader 10 can include a material handling attachment 20. The material handling attachment 20 can be coupled with the fork attachment 12.

The material handling attachment 20 can comprise two clamping devices, where the fork attachment 12 includes a clamping device 22 (i.e., a primary load retention apparatus) coupled with the fork attachment 12, located on either side of the fork tines 14. Each clamping device 22 can comprise a first clamping device frame element 24 (i.e., a first load retention apparatus element), a second clamping device frame element 26 (i.e., a second load retention apparatus element), and a third clamping device frame element 28 (i.e., a third load retention apparatus element). The where the second clamping device frame element includes a first section 26A and a second section 26B, where the first section 26A and the second section 26B are positioned at an angle of approximately 90 degrees with respect to each other.

As seen in FIG. 2, each of the clamping devices 22 can also include a first movement actuator 30 (i.e., a first movement mechanism) (e.g., a hydraulic cylinder, a pneumatic cylinder, a screw mechanism, etc.). Each of the clamping devices 22 can be rigidly connected by one or more support members 32. The support members 22 can provide rigidity and stability to the clamping devices 22 to assist in securing loads.

The second clamping device element 28 can comprise a first section 26A and a second section 26B.

The third clamping device frame element 28 is movably coupled with the second clamping device frame element 26 by a second movement actuator 34 (i.e., a second movement mechanism) (i.e., together with the third clamping device frame element 28, a secondary load retention apparatus). For example, the second movement actuator 34 can comprise a scissor mechanism, as shown in FIG. 2, which can be used to move the third clamping device frame element 28 with respect to the second clamping device frame element 26. FIG. 2 shows the third clamping device frame element 28 in an extended position. (See FIG. 3 for an example of the third clamping device frame element 28 in a retracted position.)

The various frame elements (24-28) and support members 32 are shown here as having a square or rectangular cross-sectional shape. Other cross-sectional shapes (e.g., round, oval, triangular, etc.) are possible but are not shown.

In some embodiments, a single clamping device 22 may work, depending on the work attachment configuration and the application. The clamping device 22 may also be configured to be attached to a work attachment (e.g., the fork attachment 12) at different locations instead of the locations shown in this embodiment.

Figure 3:
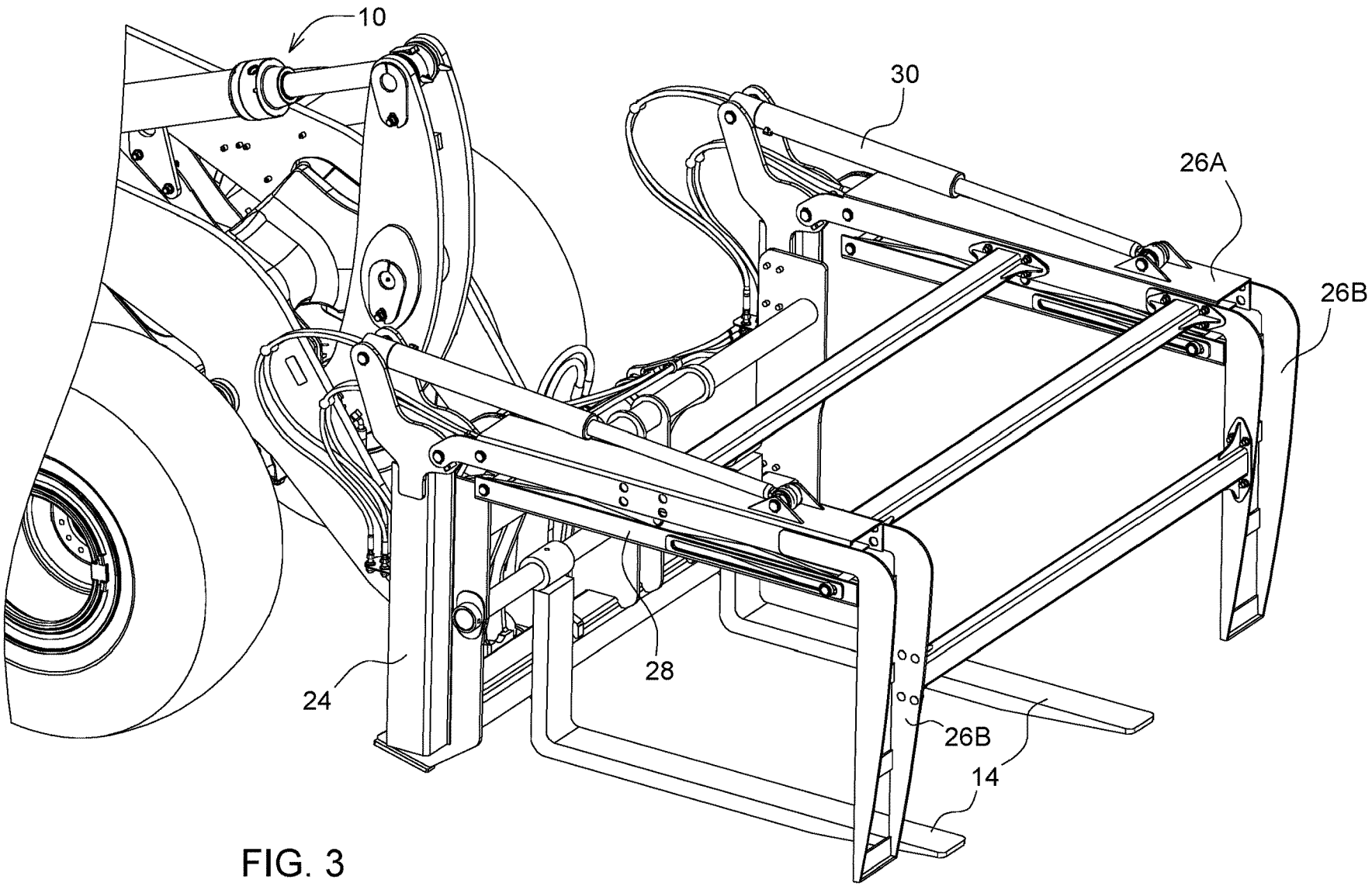
FIG. 3 is an isometric view of the wheel loader 10 with a fork attachment and the material handling attachment, consistent with embodiments of the present disclosure.

FIG. 3 is an isometric view of the wheel loader 10 with a fork attachment 12 and the material handling attachment 20, consistent with embodiments of the present disclosure. As described above, each clamping device 22 can comprise the first clamping device frame element 24, the second clamping device frame element 26, and the third clamping device frame element 28. The movement actuator 30 is shown in FIG. 3 and the scissor mechanism 34 is hidden in the retracted position of the third clamping device frame element 28.

Figure 4:
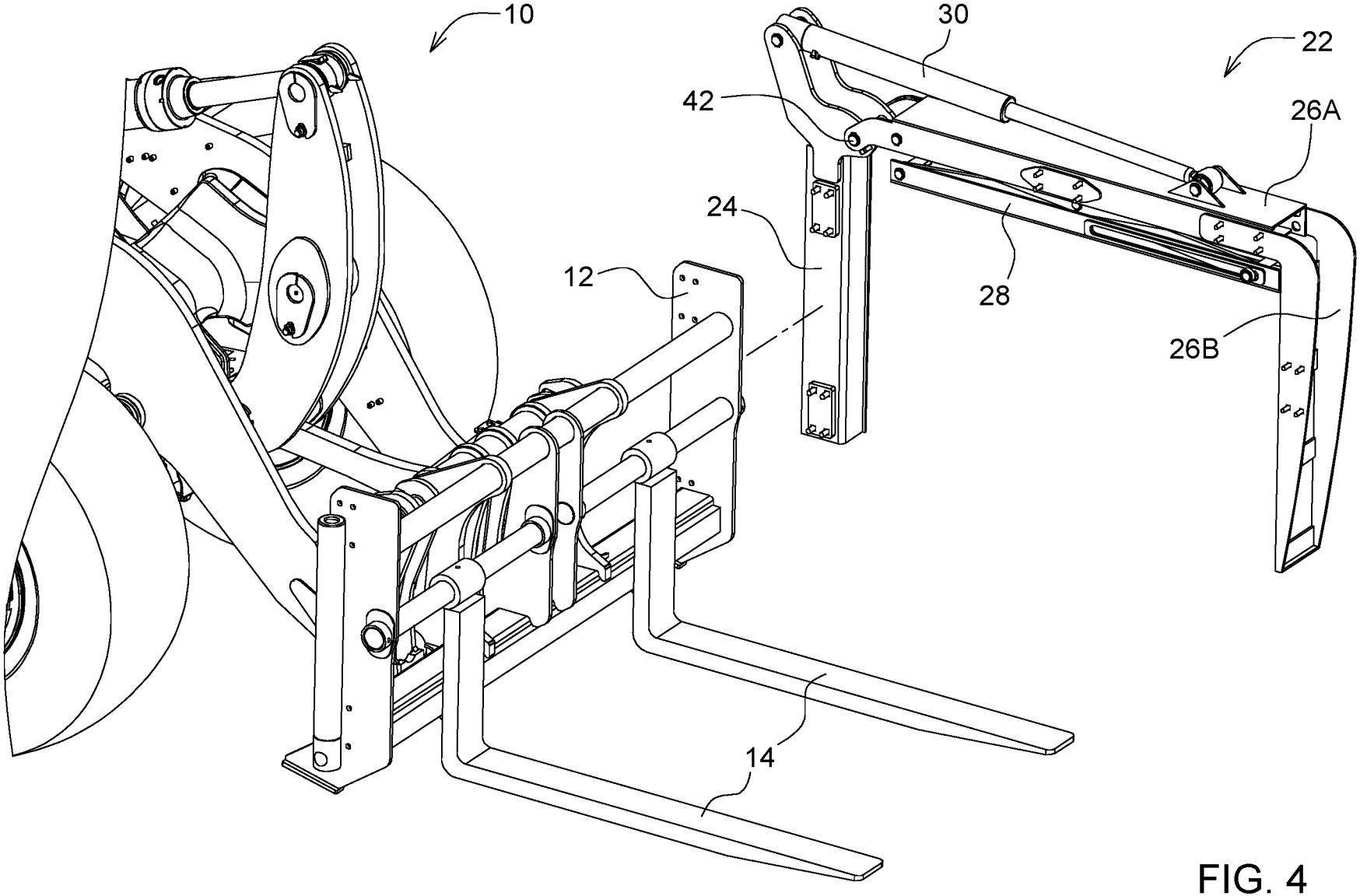
FIG. 4 is an isometric view of the one of the clamping devices in position to be attached to the fork attachment, consistent with embodiments of the present disclosure.

FIG. 4 is an isometric view of the one of the clamping devices 22 in position to be attached to the fork attachment 12, consistent with embodiments of the present disclosure. As described above each clamping device can comprise a first clamping device frame element 24, a second clamping device frame element 26, and a third clamping device frame element 28. As shown in FIG. 4, the clamping device 22 can be coupled to a portion of the fork attachment 12. The clamping device 22 can be removably secured by fasteners (i.e., bolts) or more permanently secured by welds.

Figure 5B:
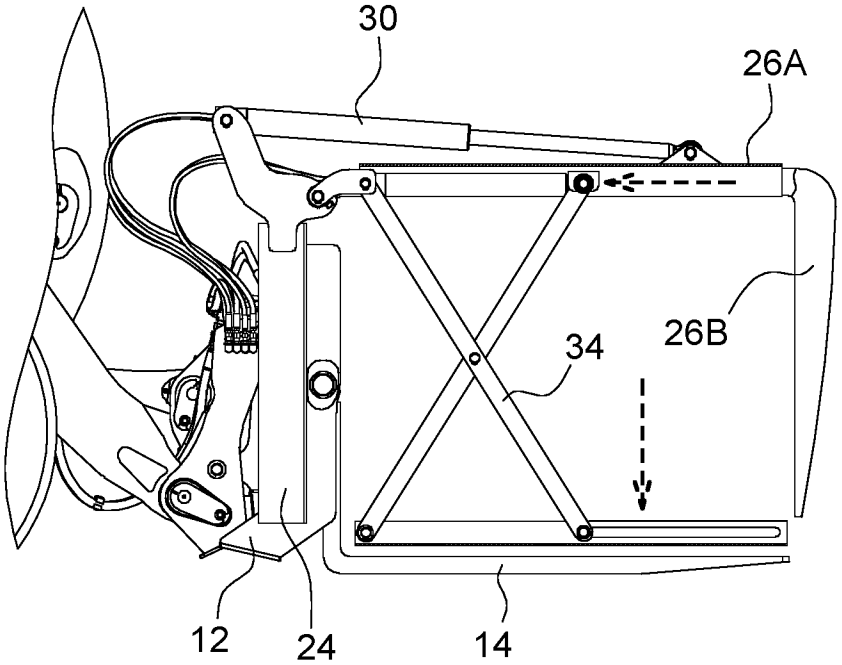
FIGS. 5A-E are side views of a portion of the wheel loader with a fork attachment including the material handling attachment, consistent with embodiments of the present disclosure.
Figure 5A:
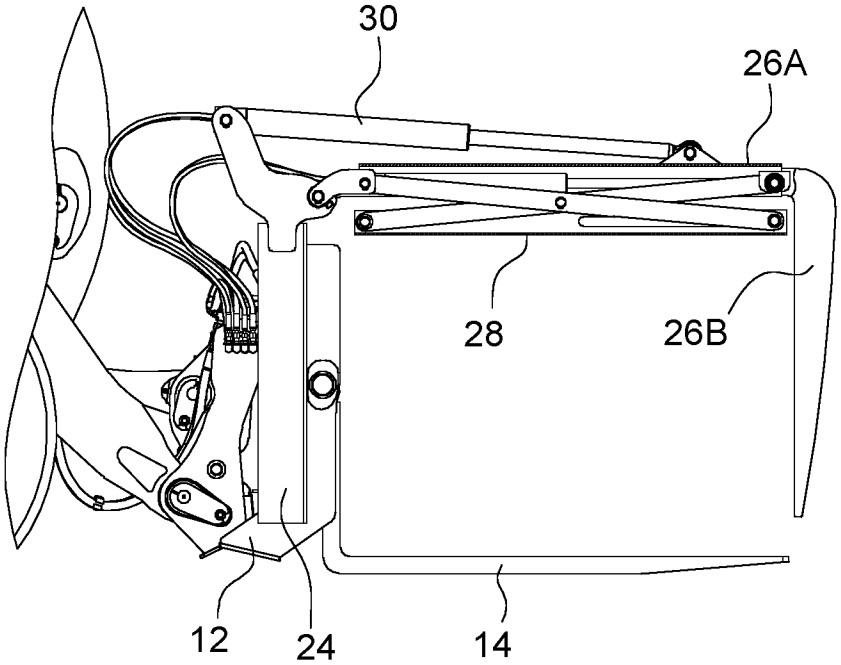

FIGS. 5A-E are side views of a portion of the wheel loader with a fork attachment including the material handling attachment, consistent with embodiments of the present disclosure. The wheel loader 10 with a fork attachment 12 and the material handling attachment 20. With the material handling attachment 20 positioned as shown in FIG. 5A with the third clamping device frame element 28 in the retracted position (i.e., the scissor actuator 34 not extended), the attachment 20 has a first carrying capacity determined by the size of the fork attachment 12 (including the length of the fork tines 14) and the position of the third clamping device frame element 28.

In FIG. 5B, the third clamping device frame element 28 is in the extended position (i.e., the scissor actuator 34 fully extended), the attachment 20 has a second carrying capacity determined by the size of the fork attachment 12 (including the length of the fork tines 14) and the position of the third clamping device frame element 28. As the position of the third clamping device frame element 28 is moved by the scissor actuator 34, the carrying capacity of the material handling attachment 20 can vary, with the maximum and minimum capacities shown in FIGS. 5A-B.

Figure 5D:
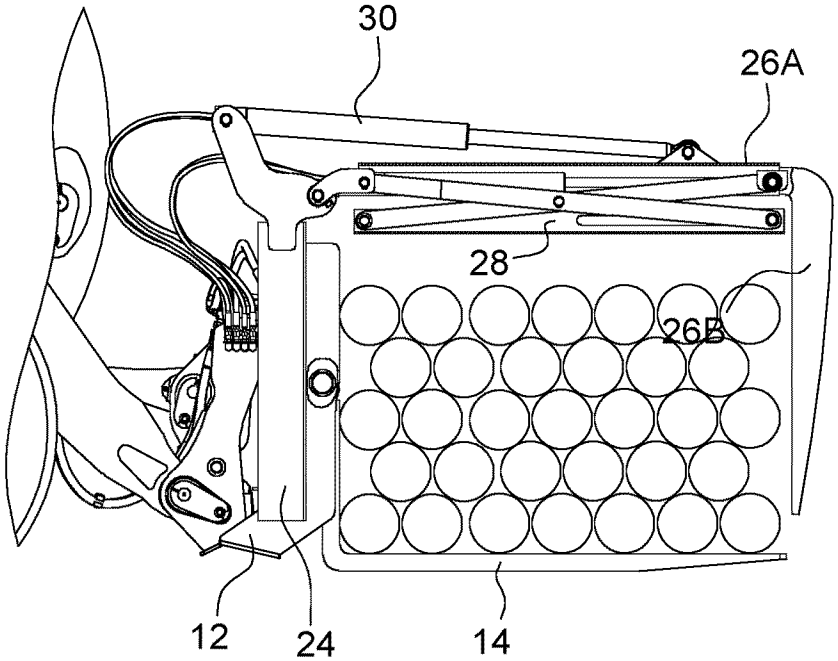
Figure 5C:
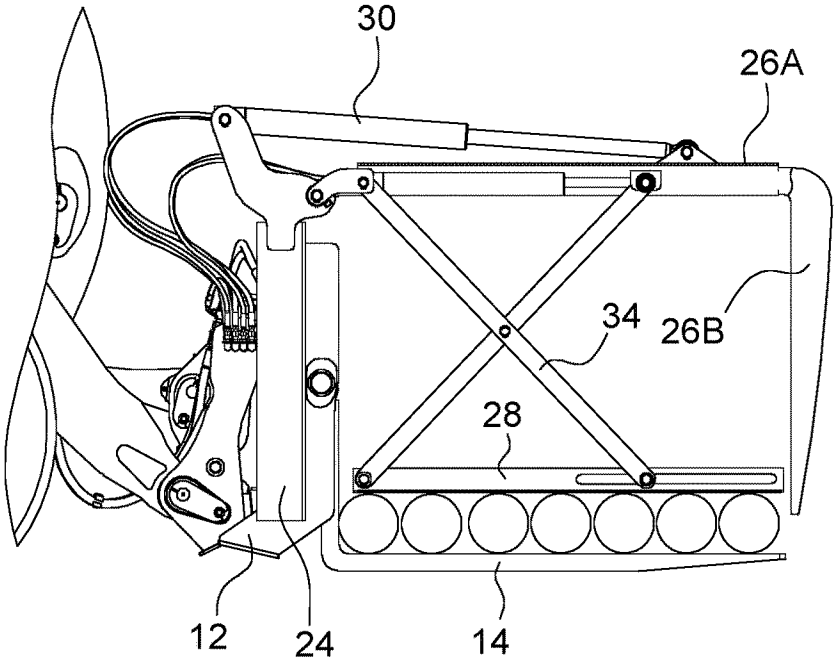

FIG. 5C shows the third clamping device frame element 28 at an intermediate position to secure a first load 36 (e.g., logs or pipes). The scissor actuator 34 can press the third clamping device frame element 28 toward the fork tines 14 to secure the first load 36.

FIG. 5D shows the third clamping device frame element 28 at another intermediate position to secure a second load 38 (e.g., logs or pipes). The scissor actuator 34 can press the third clamping device frame element 28 toward the fork tines 14 to secure the second load 38.

Figure 5E:
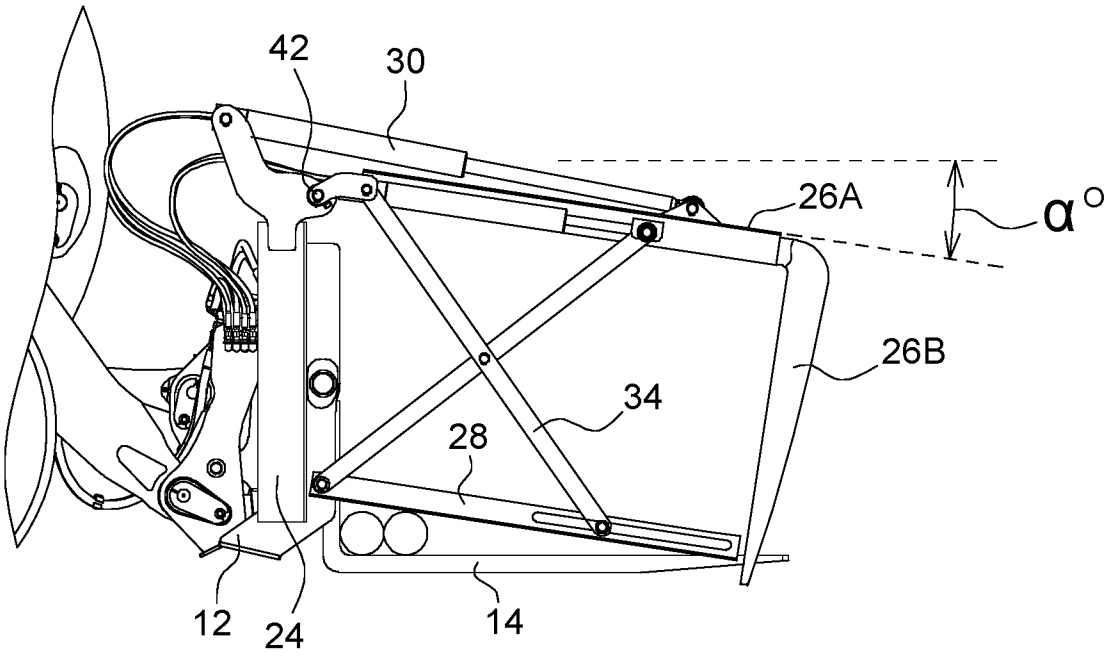

FIG. 5E shows the third clamping device frame element 28 at yet another intermediate position to secure a third load 40 (e.g., logs or pipes). In addition to the scissor actuator 34 pressing the third clamping device frame element 28 toward the fork tines 14 to secure the third load 38, the first movement actuator 30 can tilt the clamping device 22, allowing the third clamping device frame element 28 to secure an uneven load like the third load 30 by preventing and/or limiting movement of the third load along a length of the fork tines 14.

Figure 6:
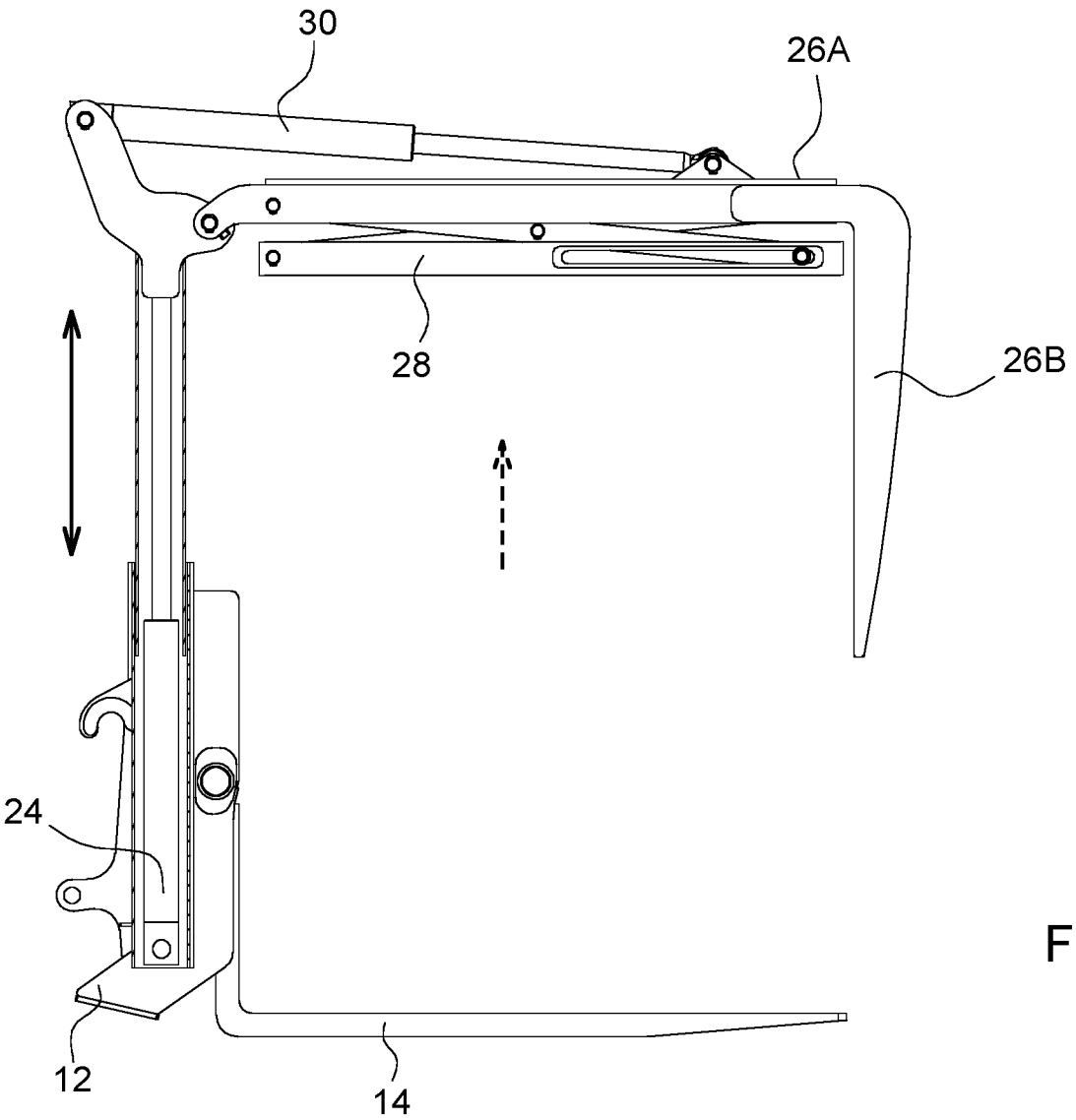
FIG. 6 is a side view of clamping device, consistent with embodiments of the present disclosure.

FIG. 6 is a side view of clamping device, consistent with embodiments of the present disclosure. The first clamping device frame element 24 can be extendable to allow for a larger carrying capacity of the material handling attachment 20. The first clamping device frame element 24 can be extendable from a first length to a second length, where the second length allows for a larger carrying capacity of the material handling attachment 20 by increasing the distance between the third clamping device frame element 28 and the fork tines 14. Extension of the first clamping device frame element can be achieved by any suitable mechanism including, for example, a hydraulic cylinder, a pneumatic cylinder, a screw mechanism, etc. Extension of first clamping device can also be done by repositioning of the first clamping structure on different mounting point on the work tool FIGS. 7A-D are side views of the material handling attachment with the clamping device, consistent with embodiments of the present disclosure. FIG. 7A shows the clamping device 22 rotated about a pivot point 42 by the first movement actuator 30 to a position where the second clamping device element 26 is parallel (or near parallel; angle between the second clamping device element 26 and the first clamping device element 24 is approximately 180°) with the first clamping device element 24. A range of pivotal movement of the second clamping device frame element 26 with respect to the first clamping device frame element 24 can be approximately 110°.

Figure 7B:
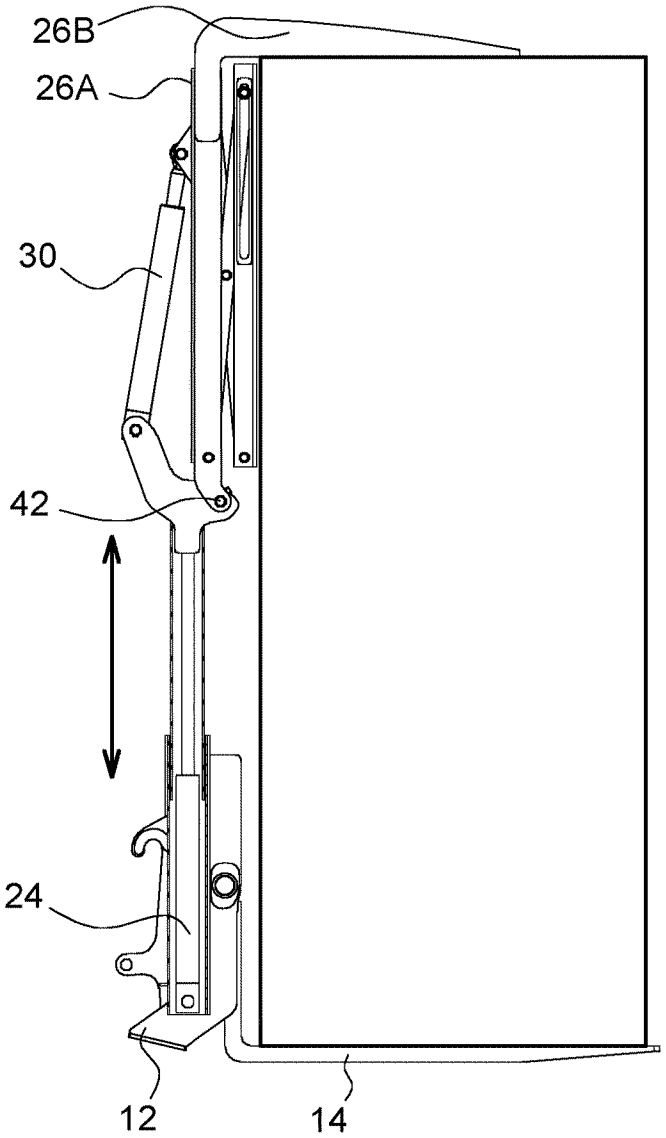
FIGS. 7A-D are side views of the material handling attachment with the clamping device, consistent with embodiments of the present disclosure.
Figure 7A:
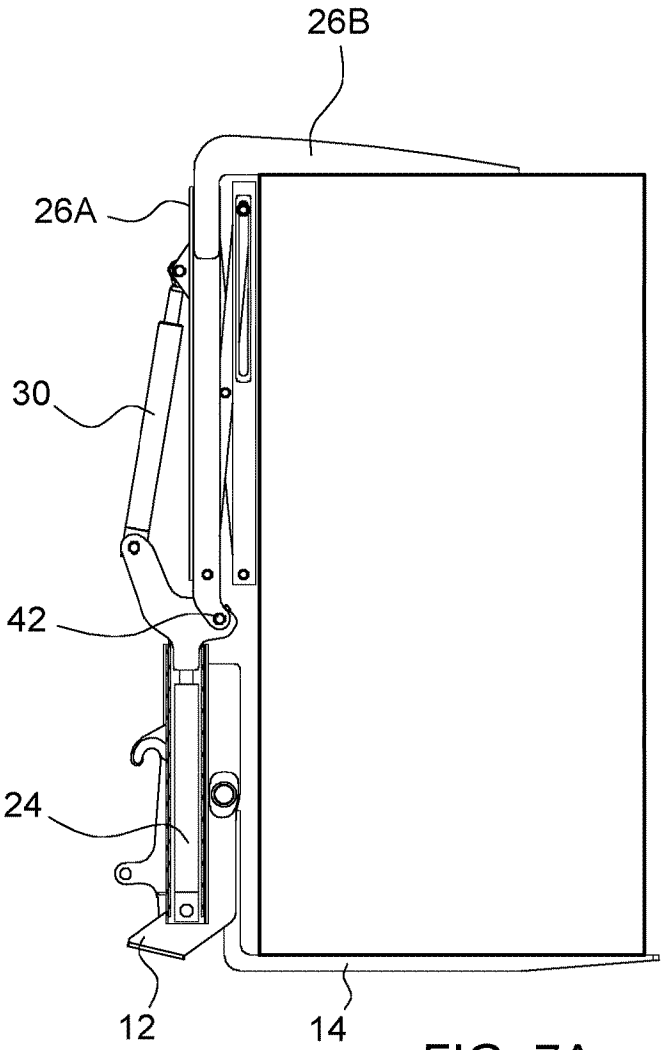

FIG. 7B shows the clamping device 22 in the same position as in FIG. 7A, but with the first clamping device frame element 24 in an extended position which increases the carrying capacity of the clamping device 22.

Figure 7C:
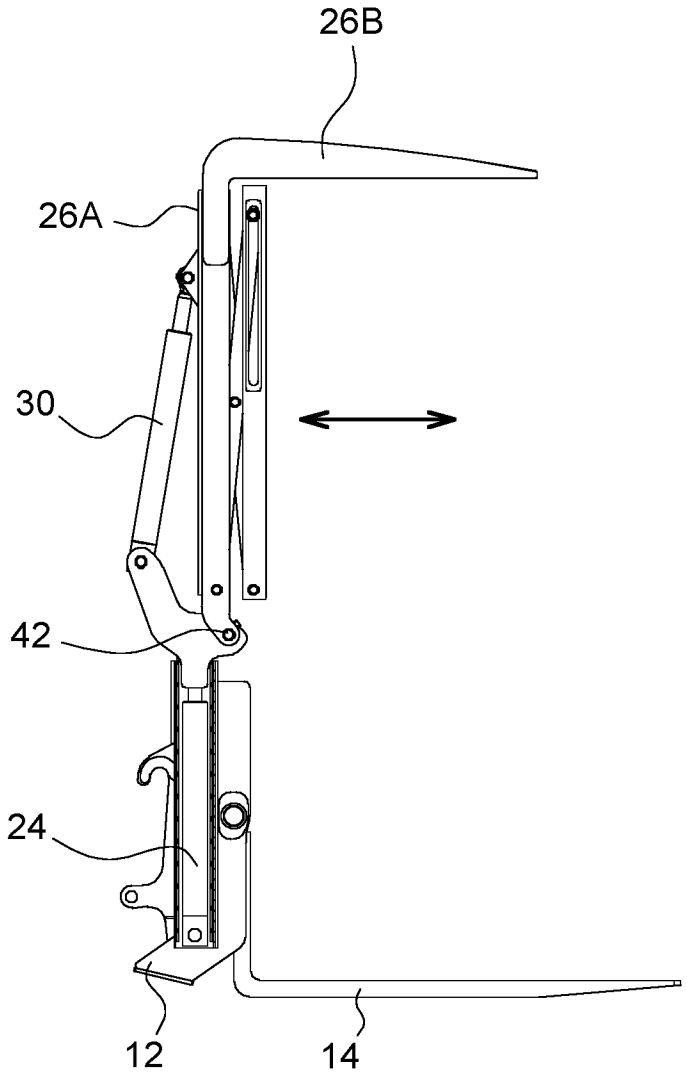
Figure 7D:
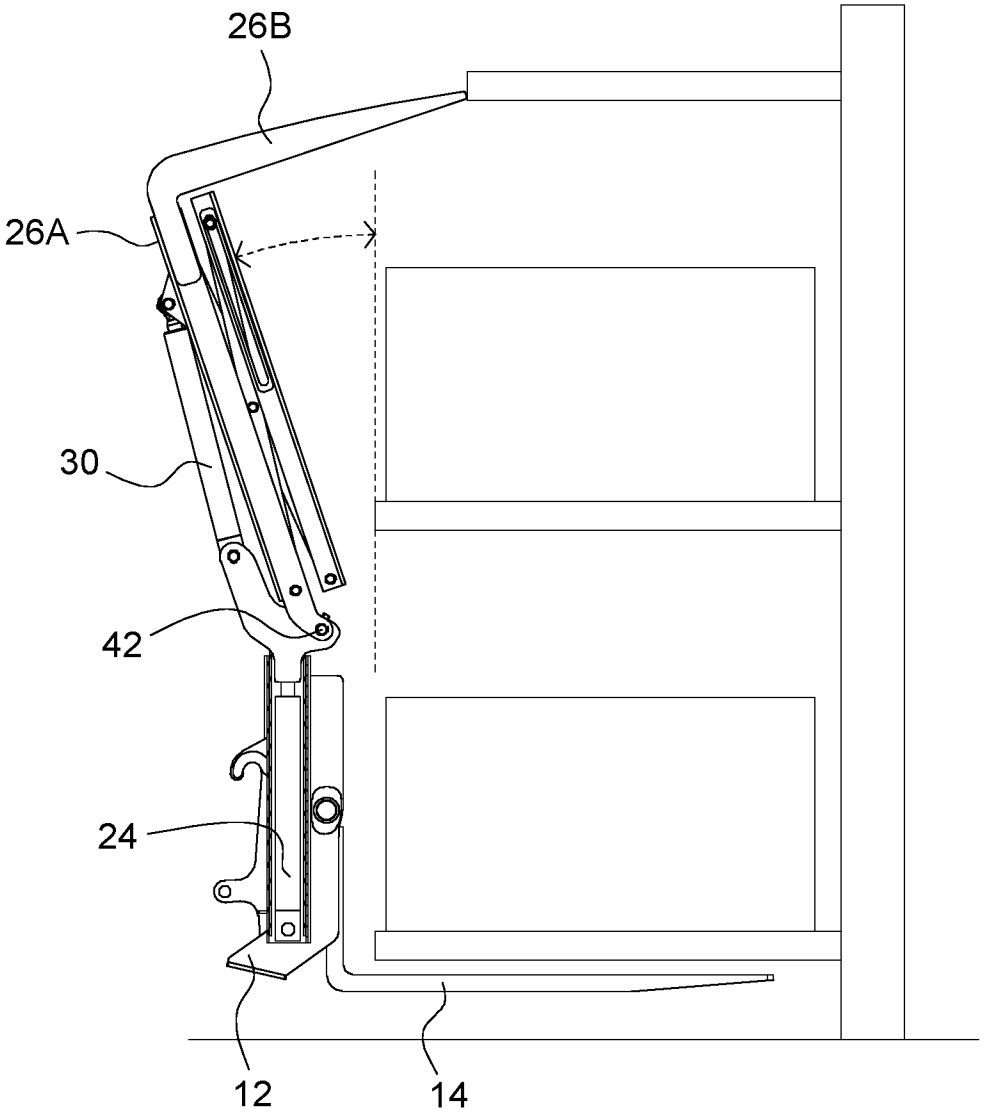

FIG. 7C show the clamping device 22 in the same position as FIGS. 7A-B. In this position, the second movement actuator 34 (i.e., the scissor mechanism) can be disabled to prevent movement of FIG. 7D shows the clamping device 22 in yet another position, where the second clamping device element 26 is rotated about the pivot point 42 to a position where an angle between the second clamping device element 26 and the first clamping device element 24 is more than 180°. This position can allow for additional flexibility of placement of the material handling attachment 20 with respect to obstacles when place/retrieving various loads. For example, this position would allow for the placement of a load into a rack system where portions of the rack system may interfere with the clamping device in certain positions.

Figure 8:
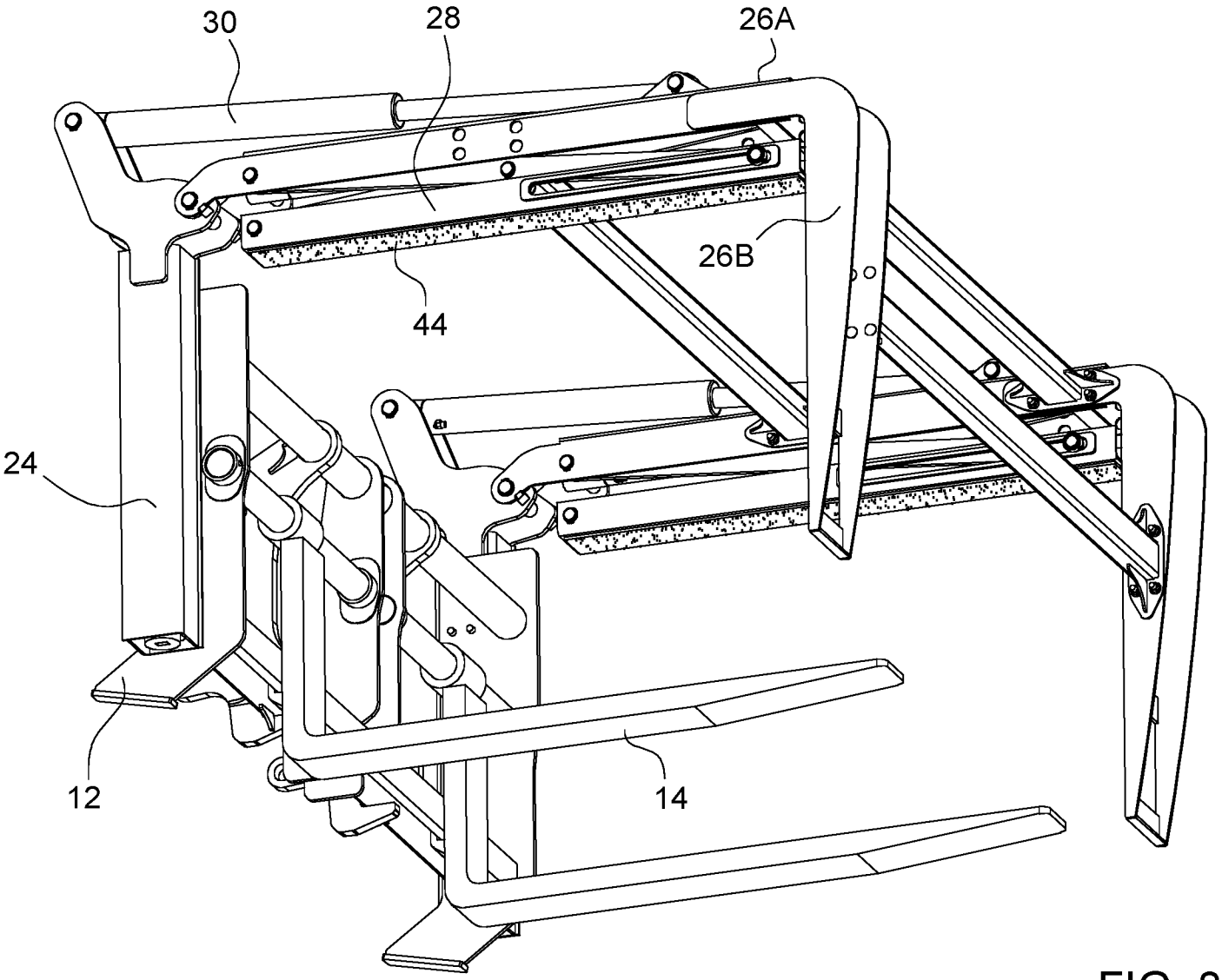
FIG. 8 is an isometric view of a fork attachment with a material handling attachment that includes a compliant material, consistent with embodiments of the present disclosure.

FIG. 8 is an isometric view of a fork attachment with a material handling attachment that includes a compliant material, consistent with embodiments of the present disclosure. A fork attachment 12 with a material handling attachment 20 can includes a compliant material on a portion of the each of the third clamping device elements 28. The compliant material can be positioned to contact a load carried by the material handling device 20 when the third clamping device element 28 is positioned to contact the load (e.g., similar to FIGS. 5C-E).

Figure 9:
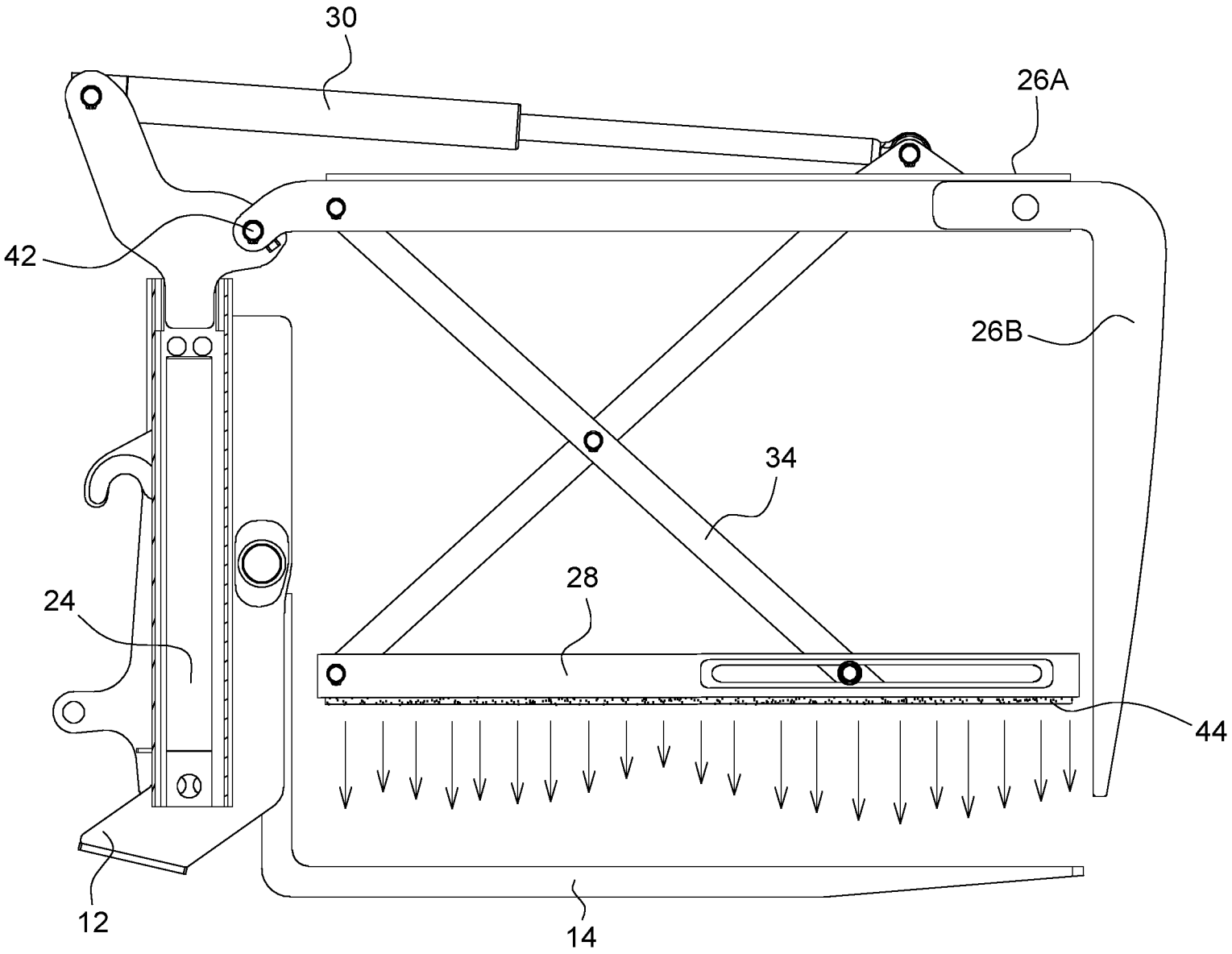
FIG. 9 is a side view of a fork attachment with a material handling attachment that includes a pressure sensitive mechanism, consistent with embodiments of the present disclosure.

FIG. 9 is a side view of a fork attachment with a material handling attachment that includes a pressure sensitive mechanism, consistent with embodiments of the present disclosure. The material handling attachment 20 can include a pressure sensitive mechanism to detect a pressure exerted by the third clamping device element 28 on a load being carried by the attachment 20. (See, e.g., FIGS. 5C-E for exemplary loads being carried by the attachment 20).

The pressure sensitive mechanism could allow, for example, carrying of loads that require care when using the material handling attachment 20 to prevent damage to the load. The pressure sensitive mechanism could assist with prevention of crushing or damaging a load when deploying the third clamping device element 28 towards the fork tines 14 to secure the load.

Numerous different types of pressure sensitive mechanisms are possible, including hydraulic or mechanical sensors. This pressure could be displayed or otherwise provided to an operator to provide feedback on pressure being used to secure the load in the material handling attachment 20.

What is claimed is:

1. A material handling attachment for a utility vehicle comprising:

a clamping device comprising:

a first clamping device frame element coupled with a portion of a work tool coupled with the utility vehicle, wherein the work tool comprises fork tines;

a second clamping device frame element pivotally coupled with the first clamping device frame element, where the second clamping device frame element includes a first section and a second section, where the first section and the second section are positioned at an angle of approximately 90 degrees relative to each other where the first section is generally parallel to the fork tines and the second section is generally perpendicular to the fork tines in a clamp position where the second section has an end proximate an end of the fork tines; and a first movement actuator that movably couples the first clamping device frame element and the second clamping device frame element;

further comprising a third clamping device frame element, where the third clamping frame device element is movably coupled with the first section of the second clamping device frame element by a second movement actuator, wherein the third clamping device frame element is movably coupled with the first section of the second clamping device frame element by a scissor mechanism, wherein the scissor mechanism comprises a first scissor mechanism element pivotally coupled with a second scissor mechanism element, and wherein a surface of the third clamping device frame element is movable into a position in which the surface is approximately parallel to a work tool surface during a first movement of the third clamping device frame element and the surface is movable into a position in which the surface is approximately perpendicular to the work tool surface during a second movement of the third clamping device frame element.

2. The material handling attachment of claim 1, wherein the work tool comprises a fork attachment.

3. The material handling attachment of claim 1, wherein the third clamping device frame element comprises a compliant material, where the compliant material is positioned to contact a load carried by the work tool.

4. The material handling attachment of claim 1, wherein a portion of first clamping device frame element is extendable from a first length to a second length.

5. The material handling attachment of claim 4, wherein the first clamping device frame element is extended by a hydraulic cylinder, a pneumatic cylinder, or a screw actuator.

6. The material handling attachment of claim 1, wherein the first movement actuator comprises a hydraulic cylinder, a pneumatic cylinder, or a screw actuator.

7. The material handling attachment of claim 1, wherein a range of movement between the first clamping device frame element and the second clamping device frame element is approximately 110 degrees.

8. A material handling attachment for a work tool, the material handling attachment comprising:

a primary load retention apparatus comprising:

a first load retention apparatus element coupled with a portion of the work tool;

a second load retention apparatus element pivotally coupled with the first load retention apparatus element, where the second load retention apparatus element includes a first section and a second section, where the first section and the second section are positioned at an angle of approximately 90 degrees relative to each another, where the first section is generally parallel to fork tines and the second section is generally perpendicular to the fork tines in a clamp position where the second section has an end proximate an end of the fork tines; and a first movement mechanism that movably couples the first load retention apparatus element and the second load retention apparatus element;

a secondary load retention apparatus comprising:

a third load retention apparatus element; and a second movement mechanism, wherein the second movement mechanism movably couples the third load retention apparatus element and the first load retention apparatus element, wherein the third load retention apparatus element is movably coupled with the second load retention element by a scissor mechanism.

9. The material handling attachment of claim 8, wherein the third load retention apparatus element further comprises a compliant material, wherein the compliant material is positioned to contact a load carried by the material handling attachment.

10. The material handling attachment of claim 8, wherein a portion of the first load retention apparatus element is extendable from a first length to a second length.

11. The material handling attachment of claim 10, wherein the portion of the first load retention apparatus element is extended by a hydraulic cylinder, a pneumatic cylinder, or a screw actuator.

12. The material handling attachment of claim 8, wherein a range of movement between the first load retention apparatus element and the second load retention apparatus element is approximately 110 degrees.

13. The material handling attachment of claim 8, further comprising two or more of the primary load retention apparatuses, and one or more support members coupling the second load retention apparatus element of each of the two or more of the primary load retention apparatuses.

14. The material handling attachment of claim 8, wherein the first movement mechanism and the second movement mechanism each comprise a hydraulic cylinder, a pneumatic cylinder, or a screw mechanism.

15. The material handling attachment of claim 8, further comprising a pressure sensing apparatus, wherein the pressure sensing apparatus is capable of detecting a pressure exerted by the third load retention apparatus element on a load carried by the material handling attachment.

* * * * *